US006988558B2

(12) United States Patent
Araki et al.

(10) Patent No.: US 6,988,558 B2
(45) Date of Patent: Jan. 24, 2006

(54) FIRE EXTINGUISHING METHOD BY GAS AND EXTINGUISHING DEVICE

(75) Inventors: Noriaki Araki, Nara (JP); Yuji Teramoto, Yawata (JP); Koichi Tamura, Kyoto (JP)

(73) Assignee: Hatsuta Seisakusho Co., Ltd., Osaka (JP)

( * ) Notice: Subject to any disclaimer, the term of this patent is extended or adjusted under 35 U.S.C. 154(b) by 288 days.

(21) Appl. No.: 10/203,054

(22) PCT Filed: Feb. 1, 2001

(86) PCT No.: PCT/JP01/00699

§ 371 (c)(1),
(2), (4) Date: Jul. 31, 2002

(87) PCT Pub. No.: WO01/56658

PCT Pub. Date: Aug. 9, 2001

(65) Prior Publication Data

US 2003/0062173 A1 Apr. 3, 2003

(30) Foreign Application Priority Data

| | | |
|---|---|---|
| Feb. 3, 2000 | (JP) | 2000-025799 |
| Sep. 5, 2000 | (JP) | 2000-268280 |
| Sep. 27, 2000 | (JP) | 2000-294038 |
| Sep. 27, 2000 | (JP) | 2000-294055 |
| Sep. 27, 2000 | (JP) | 2000-294067 |

(51) Int. Cl.
*A62C 2/00* (2006.01)

(52) U.S. Cl. ..... 169/46; 169/11; 169/14; 169/44; 169/62; 239/310; 239/311; 252/3; 252/8

(58) Field of Classification Search ..... 169/9, 169/11, 14, 43, 44, 46, 62; 239/310, 311; 252/3, 8

See application file for complete search history.

(56) References Cited

U.S. PATENT DOCUMENTS

| | | | | | |
|---|---|---|---|---|---|
| 4,951,754 | A | * | 8/1990 | Solheim | 169/9 |
| 5,727,635 | A | * | 3/1998 | Doty et al. | 169/62 |
| 5,810,090 | A | * | 9/1998 | Sundholm | 169/46 |
| 6,267,183 | B1 | * | 7/2001 | Smagac | 169/14 |

FOREIGN PATENT DOCUMENTS

| | | |
|---|---|---|
| JP | 9-511923 | 9/1997 |
| WO | WO 95/28205 | 10/1995 |

* cited by examiner

*Primary Examiner*—Steven J. Ganey
(74) *Attorney, Agent, or Firm*—Kolisch Hartwell, P.C.

(57) ABSTRACT

A method of fire extinguishment with a gas, characterized by extinguishing a fire by ejecting at least one gaseous fire-extinguishing agent selected from the group consisting of argon, nitrogen, and carbon dioxide using a foam, powder, or water as a carrier.

7 Claims, No Drawings

FIRE EXTINGUISHING METHOD BY GAS AND EXTINGUISHING DEVICE

TECHNICAL FIELD OF THE INVENTION

The present invention relates to a fire extinguishing method by gas and to a fire extinguishing device in which fire extinguishing chemical of a gas type is discharged using foams, powder or water as a carrier to extinguish the fire.

PRIOR ART

There has been a problem that, when a fire extinguishing chemical of a gas type is discharged into the air upon extinguishing, the discharging distance corresponding to the discharging pressure is available but, even when it is discharged continuously, no more discharging distance than the discharging pressure is available and, during that distance, it is diluted by air whereby the time wherein a sufficient concentration of the fire extinguishing chemical of a gas type exists is not available and the extinguishing effect is not well achieved.

PROBLEMS THAT THE INVENTION IS TO SOLVE

The present invention has been devised in view of the above-mentioned problems in the prior art and an object is to provide a fire extinguishing method by gas and a fire extinguishing device having an excellent extinguishing effect where the discharging distance of the extinguishing chemical of a gas type is effectively available and the fire extinguishing chemical of a gas type is not sprinkled but is carried in a state of sufficient concentrations.

MEANS FOR SOLVING THE PROBLEMS

The present inventor has carried out an intensive investigation for achieving the above object and found that, when a fire extinguishing chemical of a gas type is carried to a burning thing using foams, powder or water as a carrier, the discharging distance can be effectively available without dilution of the extinguishing chemical of a gas type and further that the extinguishing efficiency is significantly improved since foams, powder or water used as a carrier also has/have a fire extinguishing action whereupon the present invention has been accomplished.

Thus, the present invention relates to a fire extinguishing method by gas, characterized in that, a fire extinguishing chemical of a gas type comprising at least one member selected from a group consisting of argon, nitrogen and carbon dioxide is discharged using foams, powder or water as a carrier so as to extinguish.

EMBODIMENTS OF THE INVENTION

The fire extinguishing chemical of a gas type used in the method of the present invention is at least one fire extinguishing chemical of a gas type selected from a group consisting of argon, nitrogen and carbon dioxide and, for example, each of argon, nitrogen and carbon dioxide may be used solely or jointly by mixing them. In the method of the present invention, it is particularly preferred to use a mixed gas of argon with nitrogen (such as IG 55 comprising 50% by volume of argon and 50% by volume of nitrogen) or just nitrogen as a fire extinguishing chemical of a gas type. Although gas of a halon type is able to be effectively used as a fire extinguishing chemical of a gas type, its use is prohibited in view of environmental problem and, therefore, it is not used in the present invention.

In the fire extinguishing chemical of a gas type used in the present invention, the above-mentioned gas can be selected and its specific gravity is preferred to be made more than that of air. When the specific gravity of the fire extinguishing chemical of a gas type to the air is more than 1.0, influence by curling up by the flame is hardly resulted and the fire extinguishing chemical of a gas type does not sprinkle but covers from the bottom of the burning things whereby extinguishing property and efficiency are improved. Accordingly, the result is as same as in the case where a fire extinguishing chemical of a gas type is infused from the bottom (surface of the floor) of the area to be extinguished and, therefore, air is selectively exhausted to outside from the upper part of the area to be extinguished whereby re-combustion and re-burning can be prevented.

It is also preferred in the method of the present invention that air is mixed with the fire extinguishing chemical of a gas type so that its oxygen concentration is made 12~15% by volume. As a result, even if someone is left alone in the fire extinguishing chemical of a gas type within an area to be extinguished, he/she is still able to breathe and is safe and, in addition, the amount of the fire extinguishing chemical of a gas type used for extinguishing can be greatly saved as compared with the sole use of a fire extinguishing chemical of a gas type.

The carrier which carries the fire extinguishing chemical of a gas type in the method of the present invention is foams, powder or water. With regard to the foams used as a carrier, there may be used foams which are produced from water containing synthetic surface-active agent where synthetic detergent is a main component, water containing a foaming substance derived from animal or vegetable where protein of animal or vegetable is a main material and water containing surface-active agent to which fluorine is added (which are called synthetic surface foams, protein foams and aqueous film foams, respectively). With regard to a method of discharging the fire extinguishing chemical of a gas type using foams as a carrier, the conventionally known method may be appropriately used and, for example, there may be adopted a method where foams are mixed with a fire extinguishing chemical of a gas type so that the fire extinguishing chemical of a gas type is incorporated into the foams and then it is discharged from a discharging pipe.

In order to effectively carry a fire extinguishing chemical of a gas type using the foams as a carrier achieving the extinguishing effect, expanded ratio of the foams and strength of the foams are important. The expanded ratio of the foams is preferably from 10- to 1000-fold or, preferably, from 50- to 500-fold. When the expanded ratio is less than 10-fold, foams are small and amount of the gas carried thereby is insufficient while, when it is more than 1000-fold, foams are too big whereby they do not efficiently reach the basement of the fire and, in addition, amount of useless fire extinguishing chemical of a gas type becomes large.

With regard to the strength of the foams, it is necessary that they have the strength in such an extent that, after they are discharged, they are not broken until reaching the burning thing or the fire and, upon contact to the burning thing or the fire, they are broken. When the foams are too weak, they are broken until reaching the burning thing after discharged whereby they are unable to effectively carry the gas to the burning thing while, when they are too strong, the foams are not broken upon reaching the burning thing, extinguishing by the gas is retarded and the useless amount of the fire extinguishing chemical of a gas type used therefor becomes large.

Thus, in order to quickly extinguish at the basement of the flame of the burning thing using a fire extinguishing chemical of a gas type, the expanded ratio (size) of the foams for carrying the gas effectively and the appropriate strength of the foams which efficiently carry out the diffusion of the gas when contacted to the burning things are necessary.

When a fire extinguishing chemical of a gas type is discharged using foams as a carrier as such, the gas is able to reach near the fire source in a state of not being sprinkled but being enclosed in the foams and, in addition, the burning thing can be effectively extinguished together with the extinguishing action of the foams per se.

With regard to the powder which is used as a carrier, there may be used common powdery fire extinguishing chemical such as an ABC powdery fire extinguishing chemical mainly comprising ammonium primary phosphate and ammonium sulfate, an BC powdery fire extinguishing chemical mainly comprising sodium bicarbonate and potassium bicarbonate and a potassium powdery fire extinguishing chemical as well as a gas-occluding alloy which adsorbs the above-mentioned fire extinguishing chemical of a gas type. With regard to the gas-occluding alloy, anything may be used so far as it has an action that the adsorbed gas is released upon stimulation by heat or by pressure and, for example, lithium zirconate powder which is able to absorb several hundred-fold (by volume) of $CO_2$ maybe used. With regard to a method where a fire extinguishing chemical of a gas type is discharged using powder as a carrier, there may be used a method where, for example, a fire extinguishing chemical of a powder type is mixed with a fire extinguishing chemical of a gas type and the mixture is discharged together from a discharging pipe when a fire extinguishing chemical of a powder type is used while, when a gas-occluding alloy is used, there may be used a method where, for example, a fire extinguishing chemical of a gas type is previously adsorbed with the gas-occluding alloy and then the gas-occluding alloy where the gas is adsorbed is discharged using a discharging pipe.

When a fire extinguishing chemical of a gas type is discharged using powder as a carrier as such, it is now possible that gas reaches near the fire source in a state of not being sprinkled but being enclosed in the powder and, in addition, even in the case of fire of metals which is said to be difficult to extinguish, the burning thing can be effectively extinguished together with the extinguishing action of the powder per se.

With regard to a method for discharging a fire extinguishing chemical of a gas type using water as a carrier, there may be adopted, for example, a method where discharging is carried out together with injecting the fire extinguishing chemical of a gas type into a water film using a discharging pipe wherefrom water can be discharged together with formation of water film.

When a fire extinguishing chemical of a gas type is discharged using water as a carrier as such, the gas is able to reach near the fire source in a state of not being sprinkled but being in a high concentration and, in addition, the burning thing can be effectively extinguished together with the extinguishing action of water per se.

In the present invention, there is further provided a fire extinguishing device where a fire extinguishing chemical of a gas type is mixed with an aqueous foaming solution of synthetic surface-activating agent, foaming substance derived from animal or vegetable or fluorine-added surface-active agent to form the foams besieging the said fire extinguishing chemical of a gas type utilizing the above-mentioned method of the present invention and the said foams are discharged and there is furthermore provided a fire extinguishing device where a gas-occluding alloy which adsorbs the fire extinguishing chemical of a gas type is contained and the said gas-occluded alloy discharges the fire extinguishing chemical of a gas type adsorbed therewith upon stimulation by heat or by pressure.

It goes without saying that the method and the device of the present invention are able to be utilized when a fire breaks out and, in addition, they can be previously installed at the place where a fire is apt to break out such as an engine room of boats and ships.

EXAMPLES

Examples of the present invention will be specifically illustrated hereinafter but the present invention is not limited thereto.

Example 1

An enclosure made of stainless steel plate was prepared in a size of 2.0 m length, 2.0 m width and 1.0 m height and a fire fighting model in a size of 500 mm length, 500 mm width and 100 mm height equipped with an edge of 30 mm width was formed at the position of about 1800 mm apart on a diagonal line from the corner of the enclosure. This fire fighting model was ignited using n-heptane as a fuel and, after a preliminary burning for 30 seconds, a fire extinguishing test was carried out. In the test, argonite (an example of the present invention) or air (a comparative example) was used as a fire extinguishing chemical of a gas type and, as a foaming agent forming the foams acting as a carrier, water containing surface-active agent (1.5% by weight) to which fluorine was added was used. The fire extinguishing chemical of a gas type and the foaming agent were mixed in a mixer, the mixture was discharged at the discharging rate of 6.0 liters/minute and discharging pressure of 0.1 MPa from a position which was 10 m apart from the fire fighting model and the time required for extinguishment was measured together with taking video pictures of the fire fighting model upon extinguishment.

Time required for extinguishment using argonite and air as a fire extinguishing chemical of a gas type was 34 seconds and 85 seconds, respectively. According to the analysis of the video picture, it was observed that, when argonite was used, it was observed to drive into the flame before the foams covered the oil surface and there was a clear difference from fire extinguishment by air. This is presumed to be that, when argonite was used, the foams contact the flame whereupon the foams were broken and the argonite in the foams were flown out and effectively affected the extinguishing. Incidentally, the expanding ratios of the foams by argonite and by air were 390-fold and 410-fold, respectively.

Example 2

An enclosure made of stainless steel plate was prepared in a size of 2.0 m length, 2.0 m width and 3.0 m height and a fire fighting model in a size of 500 mm length, 500 mm width and 100 mm height equipped with an edge of 30 mm width was formed at the position of about 1600 mm apart on a diagonal line from the corner of the enclosure. This fire fighting model was ignited using n-heptane as a fuel and, after a preliminary burning for 30 seconds, a fire extinguishing test was carried out. In the test, argonite (an example of the present invention) or air (a comparative example) was used as a fire extinguishing chemical of a gas type and, as a foaming agent forming the foams acting as a carrier, water containing a synthetic surface-active agent (1.5% by weight)

was used. The fire extinguishing chemical of a gas type and the foaming agent were mixed in a mixer, the mixture was discharged at the discharging rate of 6.0 liters/minute and discharging pressure of 0.1 MPa from a position which was 10 m apart from the fire fighting model and the time required for extinguishing was measured together with taking video pictures of the fire fighting model upon extinguishment.

When argonite was used as a fire extinguishing chemical of a gas type, fire was extinguished within 39 seconds while, when air was used, no extinguishment was achieved even after 4 minutes and 30 seconds. According to the analysis of the video pictures, it was observed that, when argonite was used, the extinguishment was noted as same as in Example 1 while, when air was used, it was observed that the foams covered the fire fighting model but burning still continued inside the foams. Incidentally, the expanding ratios of the foams by argonite and by air were 450-fold and 490-fold, respectively.

Example 3

A concave hollow in a size of 1.0 m width, 2.0 m height and 10 m length where the upper part was open was prepared, a foaming device was placed at the inlet and a square bath in a size of 0.5 m length and 0.5 m width was placed 9 m apart therefrom. Gasoline was placed in the square bath and ignited and foams were discharged from the foaming device to the square bath to carry out a fire extinguishing test. With regard to the foaming device, a standard high-foaming device according to "Ordinance for Regulating the Technical Standards for Fire Extinguisher of a Foam Type" of Ordinance No. 26 issued by the Ministry of Home Affairs was used and, with regard to the foams, three types of "weak, appropriate and strong" were prepared. Incidentally, the foaming ratios were within a property of from 400-fold to 500-fold in all cases and discharging was carried out so that argonite came into the foams.

Result of the fire extinguishing test was as follows.

| State of Foams | Weak Foams | Appropriate Foams | Strong Foams |
|---|---|---|---|
| State of Progress of Foams | Foams were broken at the place of 5~7 m from the foaming device | Foams proceeded from the foaming device, exceeded the edge of the square bath and more than one half contacted the flame and were broken | Foams exceeded the edge of the square bath and, even contacted the flame, they were not broken but proceeded thereover. |
| State of Extinguishment | Foams were broken halfway and the gas did not reach as well, so extinguishment within a predetermined period was not possible | Extinguishment completed within 2 minutes and 30 seconds | Burning still continued for a short while even when covered with the foams and more than 10 minutes were needed for extinguishment |

As will be apparent from the above-mentioned result, strength of the foams is selected to be appropriate depending upon the burning state of the dangerous article and, when the foams are too weak or too strong, it is not possible to extinguish the fire within a predetermined period. Incidentally, when the length of the cave was changed to 20 m, the same result was obtained as well.

Example 4

An enclosure made of stainless steel plate was prepared in a size of 2.0 m length, 2.0 m width and 1.0 m height and a fire fighting model in a size of 500 mm length, 500 mm width and 100 mm height equipped with an edge of 30 mm width was formed at the position of about 1800 mm apart on a diagonal line from the corner of the enclosure. This fire fighting model was subjected to a metal firing and, after a preliminary burning for 30 seconds, a fire extinguishing test was carried out. In the test, argonite was used as a fire extinguishing chemical of a gas type and, as a powder acting as a carrier, a fire extinguishing chemical of a powder type formetal fire was used. The fire extinguishing chemical of a powder type for metal fire was mixed with argonite in a mixer, the mixture was discharged with a discharging pressure of 0.1 MPa from a position which was 10 m apart from the fire fighting model and the time required for extinguishing was measured. Time for extinguishment was 30 seconds and it was observed that, due to a synergism of argonite with the fire extinguishing chemical of a powder type for metal fire, extinguishment quickly took place.

Example 5

An enclosure made of stainless steel plate was prepared in a size of 2.0 m length, 2.0 m width and 1.0 m height and a fire fighting model in a size of 500 mm length, 500 mm width and 100 mm height equipped with an edge of 30 mm width was formed at the position of about 1800 mm apart on a diagonal line from the corner of the enclosure. This fire fighting model was ignited using n-heptane as a fuel and, after a preliminary burning for 30 seconds, a fire extinguishing test was carried out. In the test, carbon dioxide was used as a fire extinguishing chemical of a gas type and, as a powder acting as a carrier, lithium zirconate was used. Lithium zirconate was previously adsorbed with 200-fold by volume of carbon dioxide, the adsorbed lithium zirconate was discharged with a discharging pressure of 0.1 MPa from a position which was 10 m apart from the fire fighting model and the time required for extinguishing was measured. Time for extinguishment was 57 seconds and it was observed that, due to carbon dioxide released from lithium zirconate, extinguishment quickly took place.

ADVANTAGE OF THE INVENTION

In accordance with the method for fire extinguishing method using gas of the present invention, there is used foams, powder or water having a fire extinguishing action as a carrier for the fire extinguishing chemical of a gas type, the discharged distance of the fire extinguishing chemical of a gas type can be effectively achieved, the fire extinguishing chemical of a gas type is not sprinkled but is able to be carried in a state of a satisfactory concentration and the fire extinguishing action of the carrier is added to the fire extinguishing action of the fire extinguishing chemical of a gas type whereby very good fire extinguishing ability is achieved.

What is claimed is:

1. A fire extinguishing method by gas, characterized in that a fire extinguishing chemical of a gas type that comprises argon and nitrogen is discharged using foams formed by water containing a synthetic surface-active agent, water containing a foaming substance derived from animal or vegetable, or water containing a surface-active agent to which fluorine is added as a carrier so as to extinguish a fire.

2. The fire extinguishing method by gas according to claim 1, wherein the expanded ratio of the foams is from 10- to 1000-fold and the foams have the strength in such an extent that, after they are discharged, they are not broken until reaching a fire and, upon contact to the fire, they are broken.

3. The fire extinguishing method by gas according to claim 2, wherein air is mixed with the fire extinguishing chemical of a gas type so that its oxygen concentration is made 12~15% by volume.

4. The fire extinguishing method by gas according to claim 1, wherein the fire extinguishing chemical of a gas type is IG 55 (50% by volume of argon and 50% by volume of nitrogen).

5. The fire extinguishing method by gas according to claim 1, wherein the specific gravity of the fire extinguishing chemical of a gas type is more than the specific gravity of air.

6. A fire extinguishing device which is characterized in that, in the device, a fire extinguishing chemical of a gas type that comprises argon and nitrogen is mixed with a foamy aqueous solution containing a synthetic surface-active agent, a foamy substance derived from animal or vegetable or a surface-active agent to which fluorine is added whereby foams enclosing the fire extinguishing chemical of a gas type are formed and then the foams are discharged.

7. The fire extinguishing device according to claim 6, wherein the device is adapted to be installed in an engine room of ships or boats.

* * * * *